United States Patent [19]

Yang

[11] Patent Number: 4,691,907

[45] Date of Patent: Sep. 8, 1987

[54] C-CLAMP STRUCTURE

[76] Inventor: Tai-Her Yang, 5-1 Taipin St., Si-Hu Town, Dzan-Hwa, Taiwan

[21] Appl. No.: 708,883

[22] Filed: Mar. 6, 1985

[51] Int. Cl.[4] ..... B25B 1/00

[52] U.S. Cl. ..... 269/152; 269/249; 269/258

[58] Field of Search ..... 269/279–284, 269/249, 258, 152, 156

[56] References Cited

U.S. PATENT DOCUMENTS

| | | | |
|---|---|---|---|
| 287,271 | 10/1883 | Gladwin | 269/249 |
| 1,349,963 | 8/1920 | Jerrim | 269/156 |
| 1,372,661 | 3/1921 | Secord | 269/156 |
| 1,531,377 | 3/1925 | Clarke | 269/156 |
| 2,318,487 | 5/1943 | Horn | 269/279 |
| 2,541,605 | 2/1951 | Ohlsson | 269/156 |
| 3,106,904 | 10/1963 | Sandres | 269/270 |
| 3,173,674 | 3/1965 | Ringle | 269/249 |
| 4,083,547 | 4/1978 | Gurley | 269/156 |
| 4,291,870 | 9/1981 | Warde | 269/279 |
| 4,476,759 | 10/1984 | Aderneck | 269/249 |

FOREIGN PATENT DOCUMENTS

| | | | |
|---|---|---|---|
| 15927 | of 1903 | United Kingdom | 269/152 |

*Primary Examiner*—Robert C. Watson
*Attorney, Agent, or Firm*—Leonard Bloom

[57] ABSTRACT

A unitary, integrally casted dual C-clamp structure is automatically adjusted by the workpiece during the clamping operation and is formed with clearance areas to facilitate the clamping of an irregularly shaped workpiece. The clamp has a common base. A pair of substantially parallel, spaced-apart supports are formed integrally with the base. Positioned on each support is a respective freely-rotatable, prismatically-shaped clamping block. The clamping blocks are spaced from one another. A slot is formed in the base below and between the clamping blocks.

1 Claim, 42 Drawing Figures

C-CLAMP STRUCTURE

BACKGROUND OF THE INVENTION

C-shaped clamp is generally used by common manufacturer for clamping two pieces of working piece, or fixing the working piece on the working table of the processing machine in order to solder, drill, lathe, grind and mill the main element of the processing work. Main structure of conventional c-shaped clamp includes a c-shaped main body and a screw which can be adjusted forward and backward, the front end of said screw possesses a movable top block, space between said top block and surface of inner side corresponding to c-shaped main body is used for accepting the working piece, and then screw is screwed to fix and clamp the working piece. If all the processed and clamped working pieces are not completely regular and plane, although the front end of screw of conventional c-shaped clamp possesses movable top block, it still can not meet the multi-use requirement of user.

SUMMARY OF THE INVENTION

The present invention relates to an improved structure of c-shaped clamp, its main character is that c-shaped clamp possesses two support arms in which its angle can be defined, on the support arm, there is clamping block which can make rotary adjustment in order to clamp irregular working piece; its further character of structure is that c-shaped clamp possesses two screws and two support arms, and on two support arms, there respectively possess clamping block which can make rotary adjustment for obtaining same function; or at the middle sectional position of support arm, there is movable connection apparatus which is suitable for clamping the working piece with small incline; or support shaft of screw of c-shaped clamp is a sectional design, and function of adjusting and defining the clamping angle can be obtained by structure of the fixing screw, polygonal support shaft, shaft hole, toothed slot, or in the middle section of support arm, there is universal connection apparatus for clamping the cubic and irregular working piece.

DETAILED DESCRIPTION OF THE INVENTION

Figure 1:
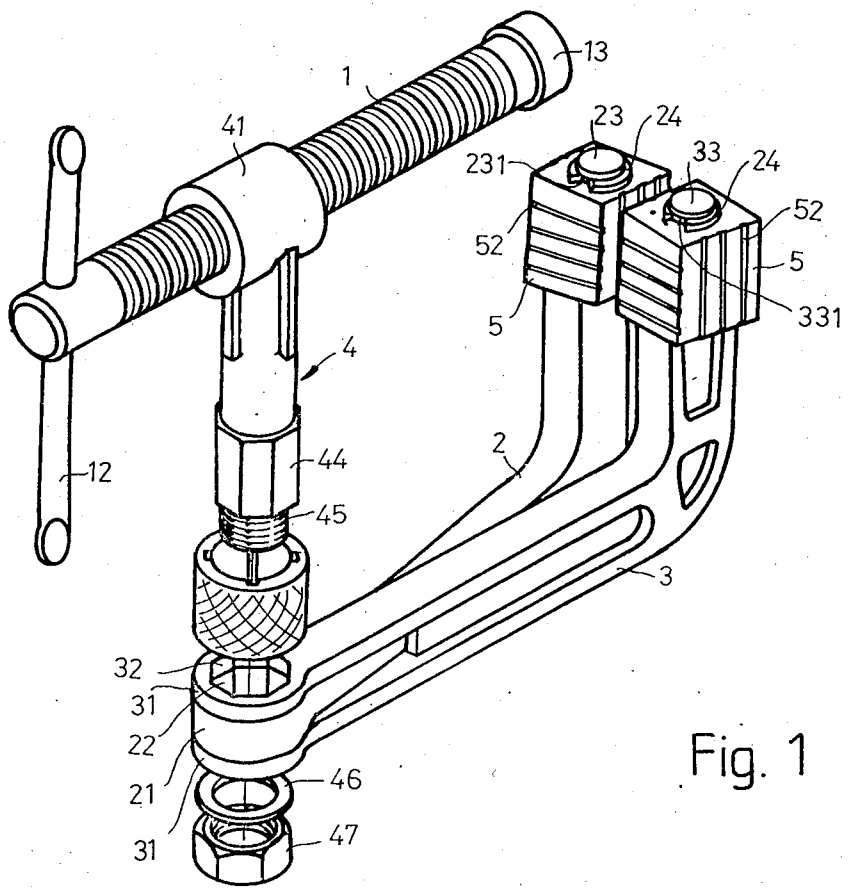
FIG. 1 is a perspectively graphic view of the structure of the present invention having two angle adjustable support arms and the clamping block which can make rotary adjustment.
Figure 3:
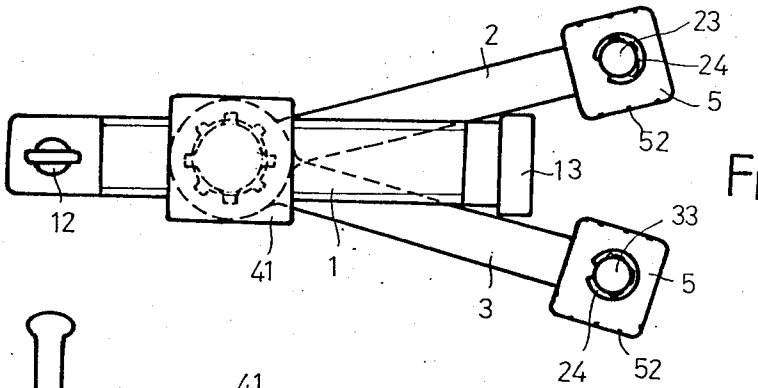
FIG. 3 is a top elevational view of the structure as shown in FIG. 1.
Figure 2:
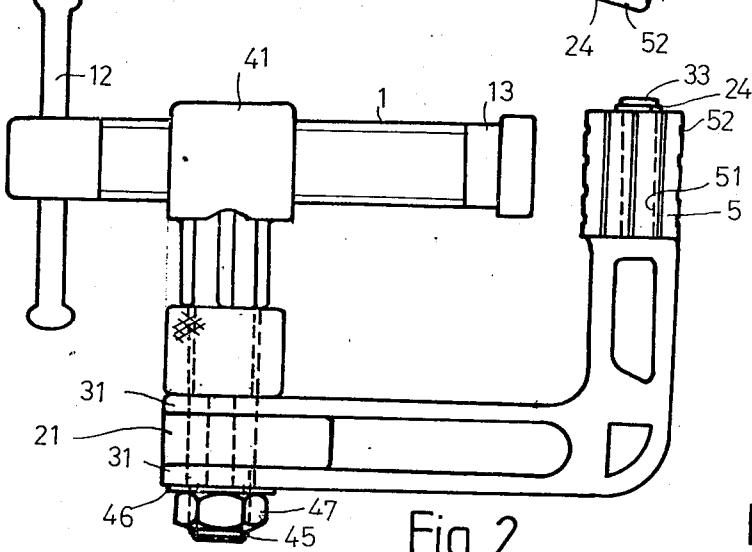
FIG. 2 is a front elevational view of the structure as shown in FIG. 1.
Figure 4:
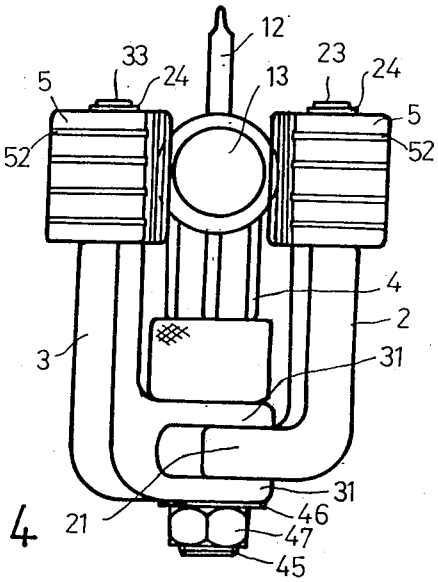
FIG. 4 is a side elevational view of the structure as shown in FIG. 1.
Figure 5:
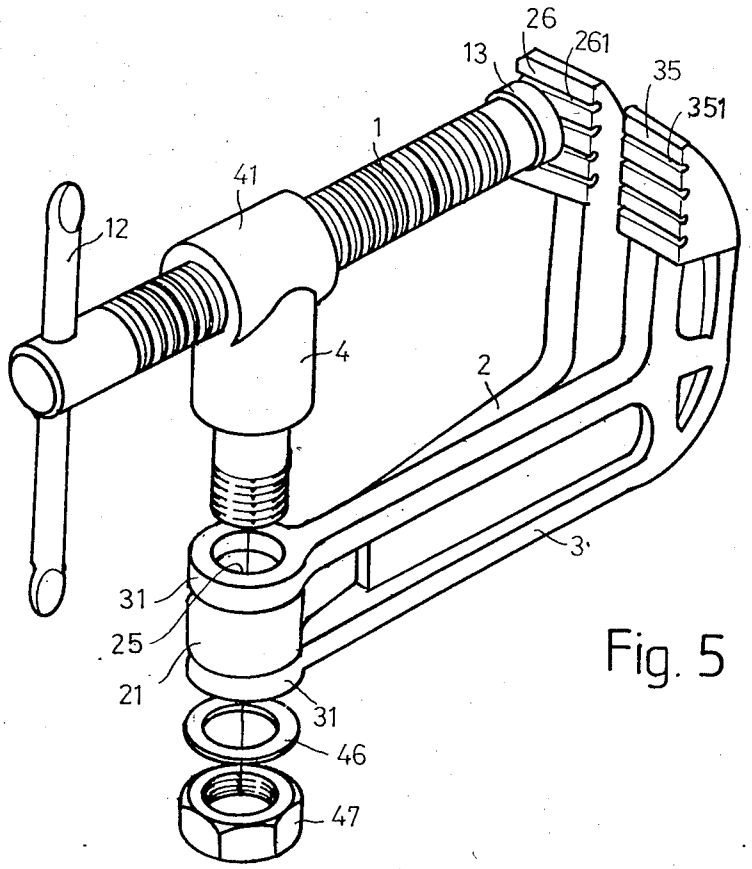
FIG. 5 is a perspectively graphic view of the structure of the present invention having structure of two angle adjustable support arms.
Figure 8:
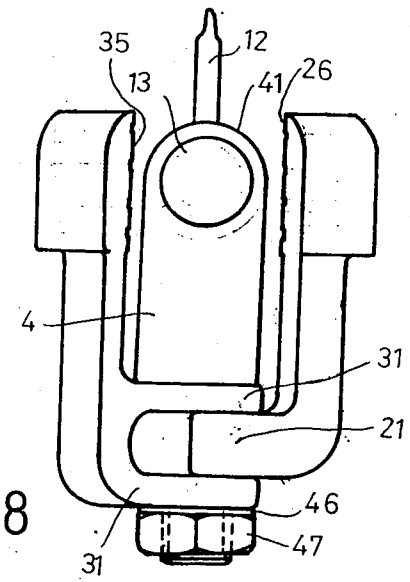
FIG. 8 is a side elevational view of the structure as shown in FIG. 5.
Figure 7:
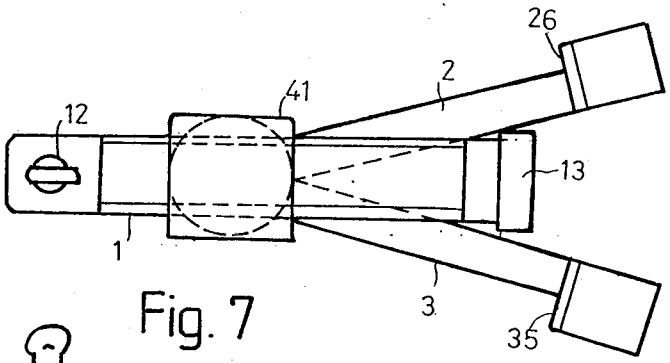
FIG. 7 is a top elevational view of the structure as shown in FIG. 5.
Figure 6:
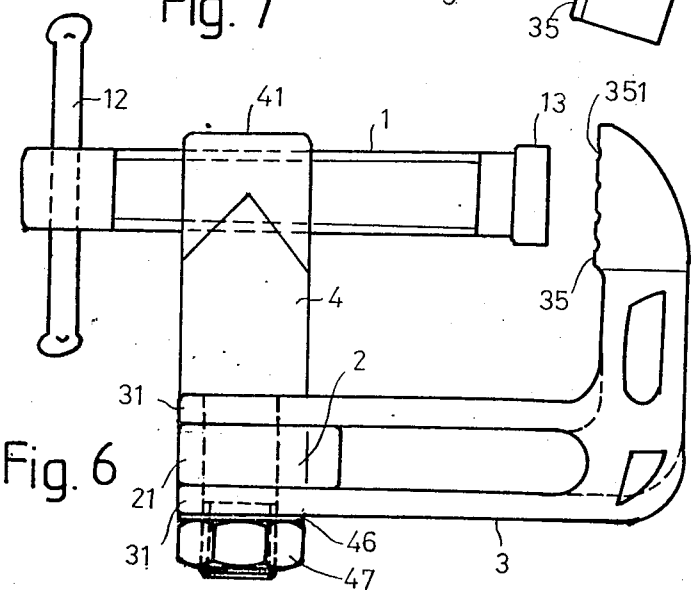
FIG. 6 is a front elevational view of the structure as shown in FIG. 5.
Figure 9:
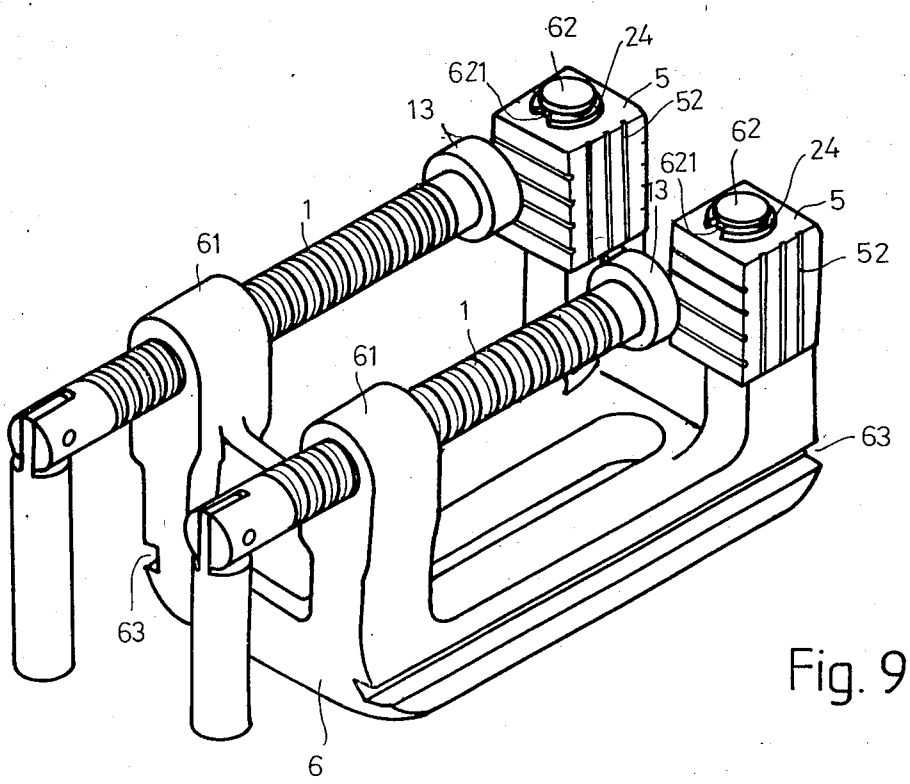
FIG. 9 is a perspectively graphic view of the structure of the present invention having double screw and double support arm.
Figure 11:
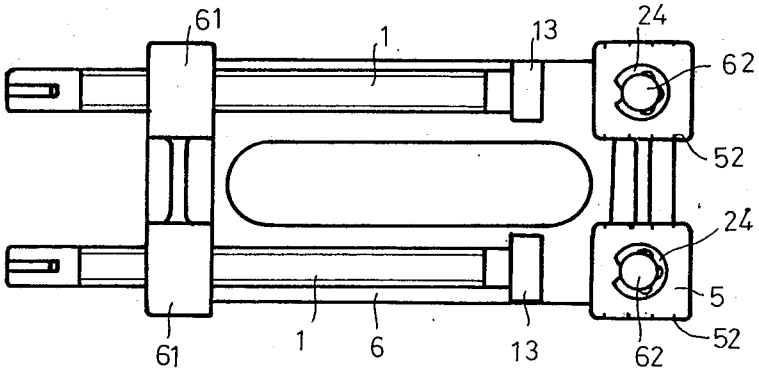
FIG. 11 is a top elevational view of the structure as shown in FIG. 9.
Figure 10:
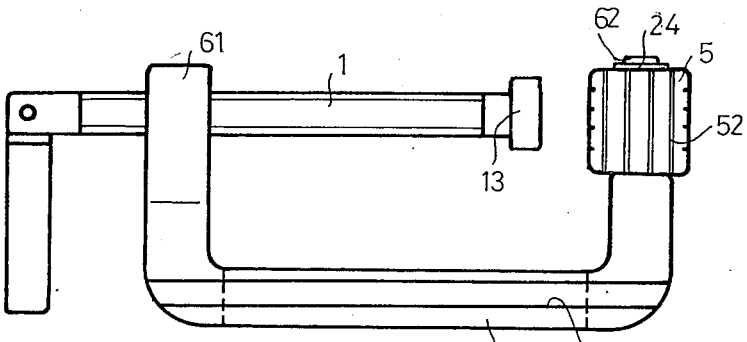
FIG. 10 is a front elevational view of the structure as shown in FIG. 9.
Figure 12:
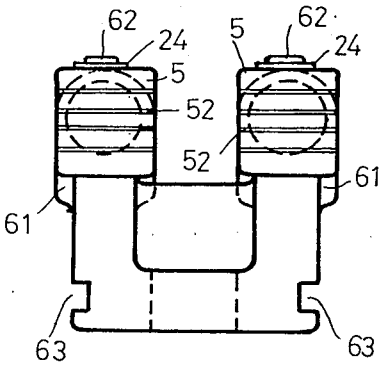
FIG. 12 is a side elevational view of the structure as shown in FIG. 9.
Figure 13:
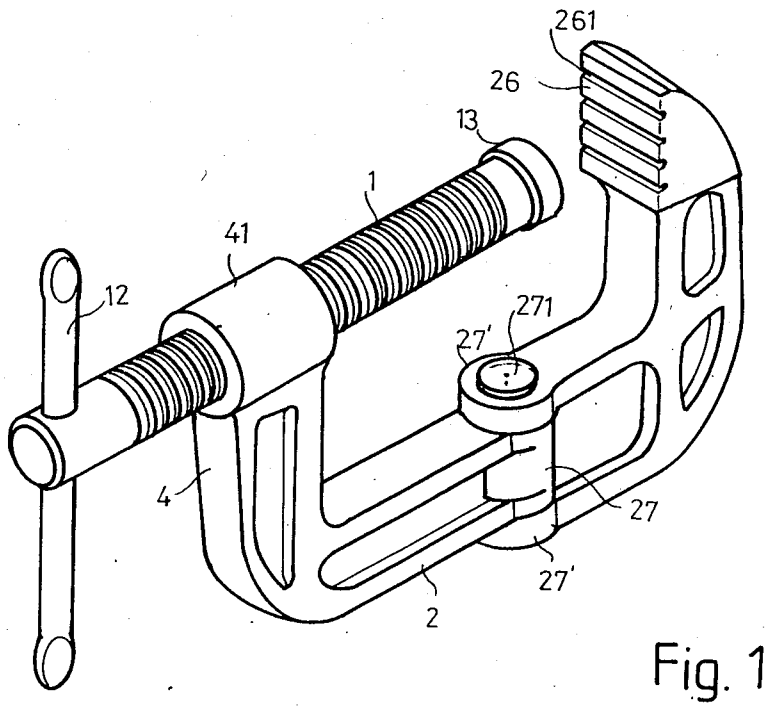
FIG. 13 is a perspectively graphic view of the structure of the present invention having movable connection apparatus in the middle section of support arm.
Figure 16:
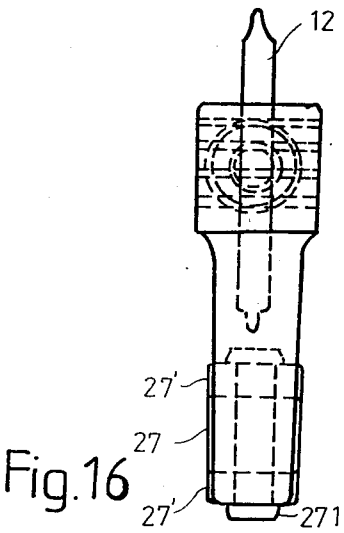
FIG. 16 is a side elevational view of the structure as shown in FIG. 13.
Figure 15:
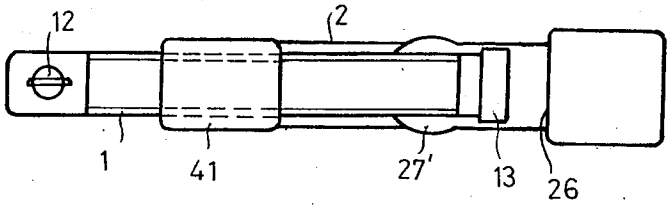
FIG. 15 is a top elevational view of the structure as shown in FIG. 13.
Figure 14:
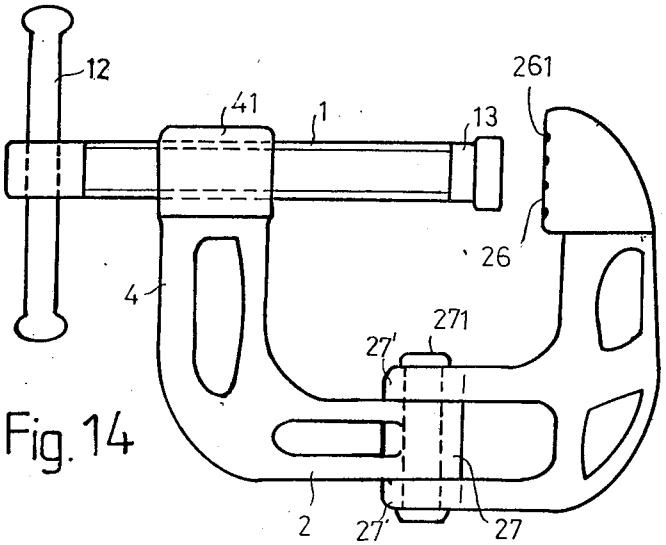
FIG. 14 is a front elevational view of the structure as shown in FIG. 13.
Figure 17:
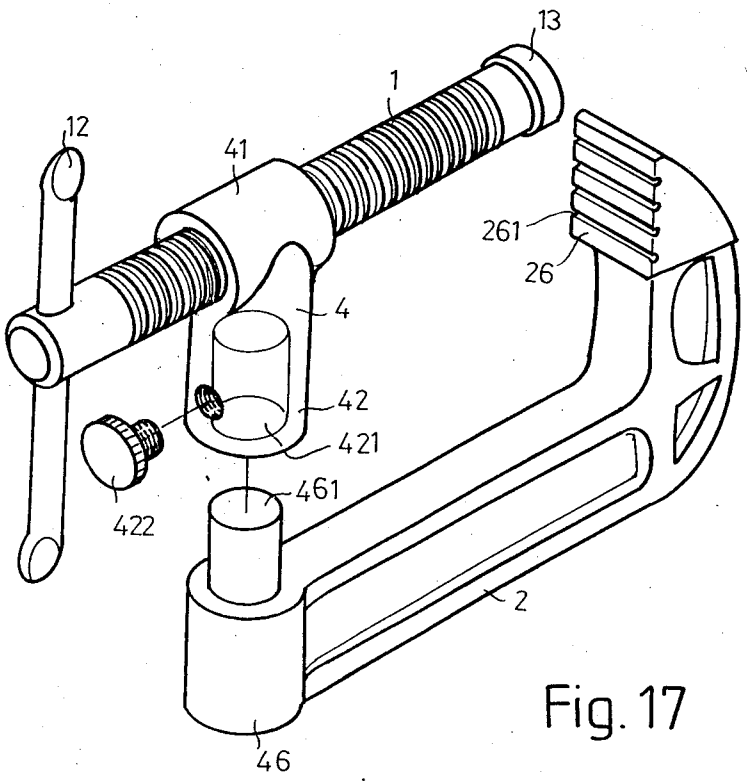
FIG. 17 is a perspectively graphic view of the structure of the present invention in which screw support shaft is sectional type and it can make angular adjusting and setting work by the fixing screw.
Figure 20:
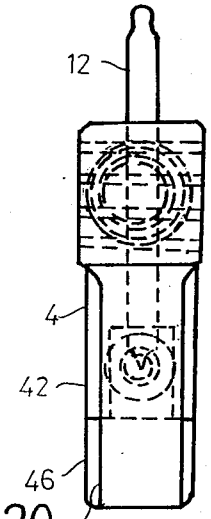
FIG. 20 is a side elevational view of the structure as shown in FIG. 17.
Figure 19:
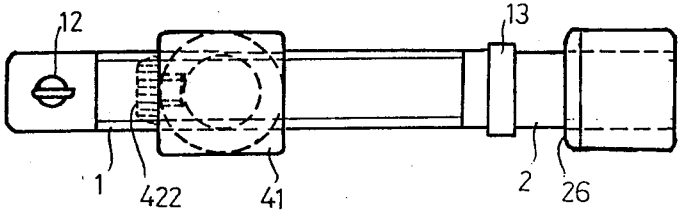
FIG. 19 is a top elevational view of the structure as shown in FIG. 17.
Figure 18:
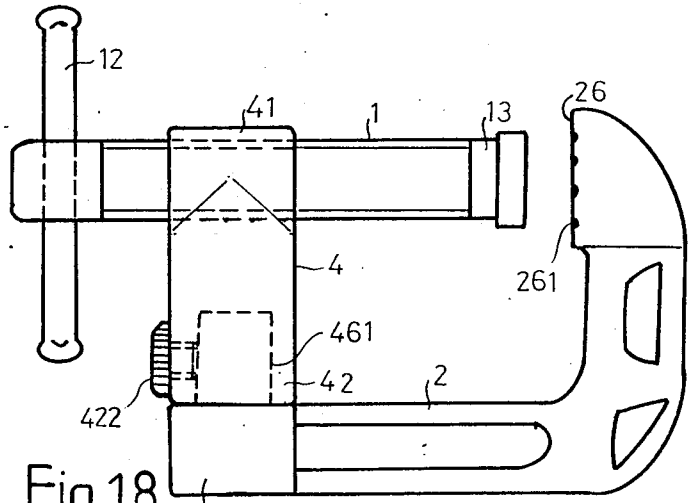
FIG. 18 is a front elevational view of the structure as shown in FIG. 17.
Figure 21:
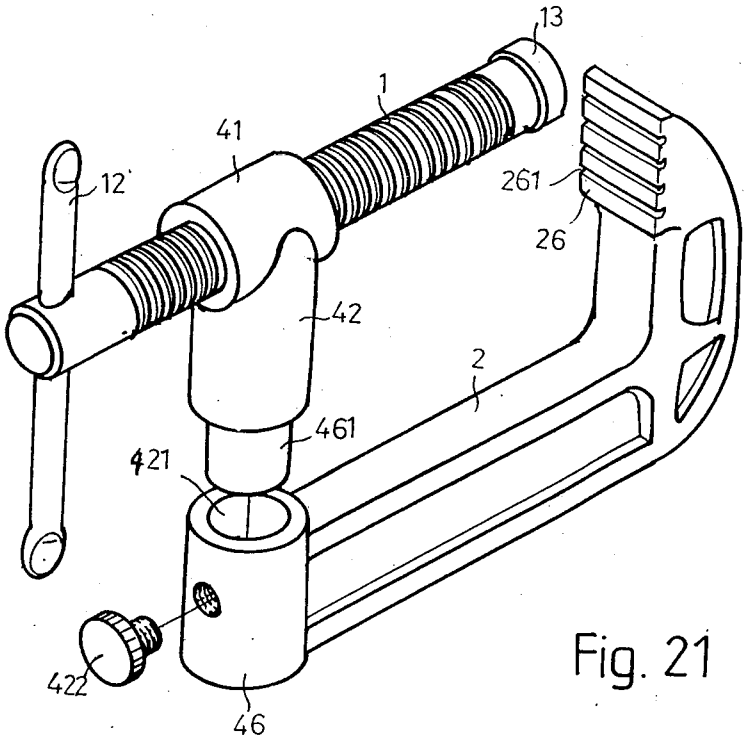
FIG. 21 is a perspectively graphic view of another embodiment of the structure as shown in FIG. 17.
Figure 24:
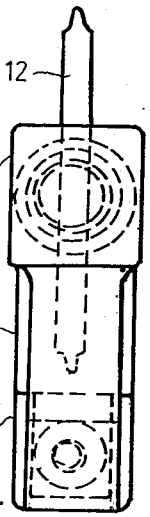
FIG. 24 is a side elevational view of the structure as shown in FIG. 21.
Figure 23:
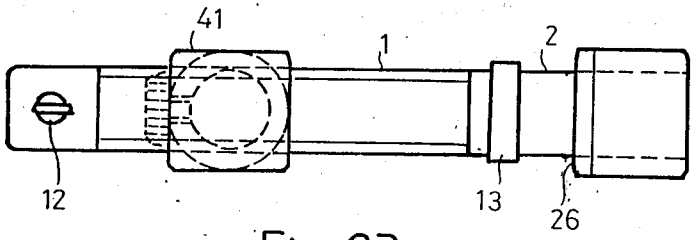
FIG. 23 is a top elevational view of the structure as shown in FIG. 21.
Figure 22:
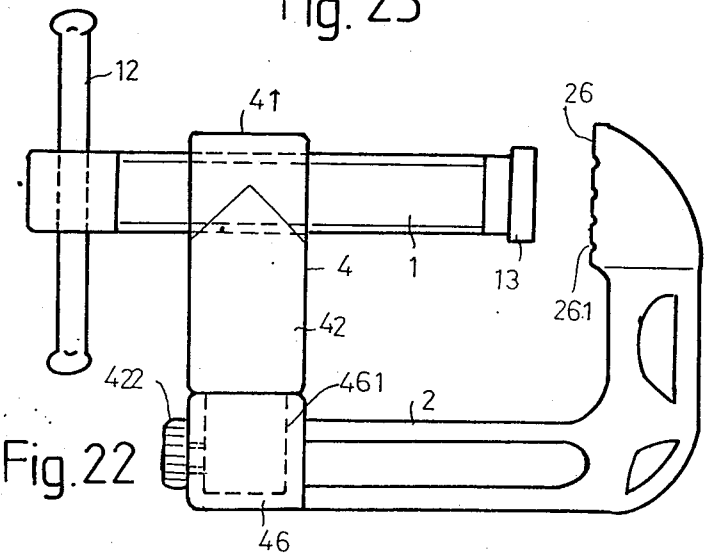
FIG. 22 is a front elevational view of the structure as shown in FIG. 21.
Figure 25:
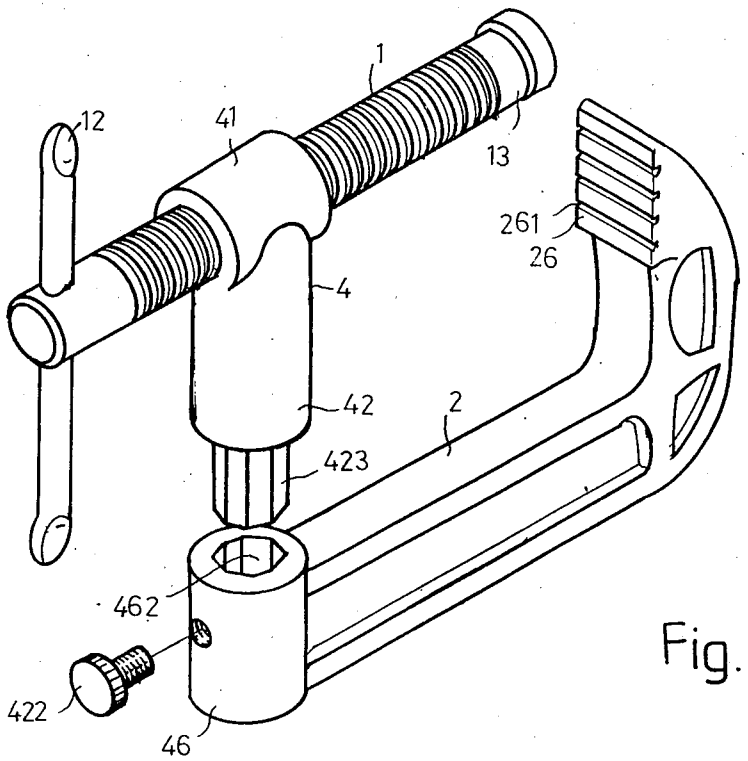
FIG. 25 is a perspectively graphic view of the structure of the present invention in which screw support shaft is sectional type and it can make angular adjusting and setting work by polygonal support shaft and shaft hole.
Figure 28:
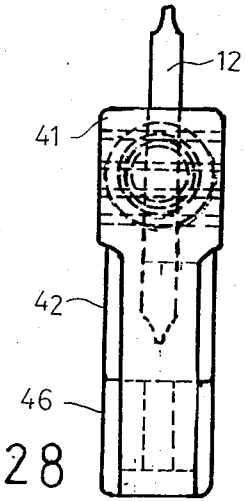
FIG. 28 is a side elevational view of the structure as shown in FIG. 25.
Figure 27:
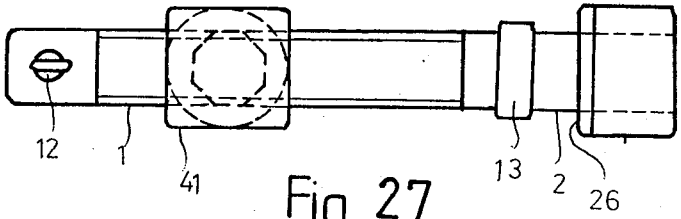
FIG. 27 is a top elevational view of the structure as shown in FIG. 25.
Figure 26:
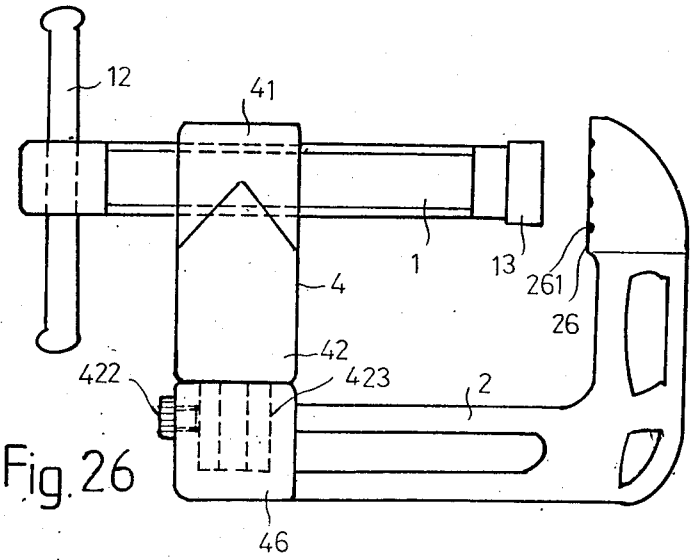
FIG. 26 is a front elevational view of the structure as shown in FIG. 25.
Figure 29:
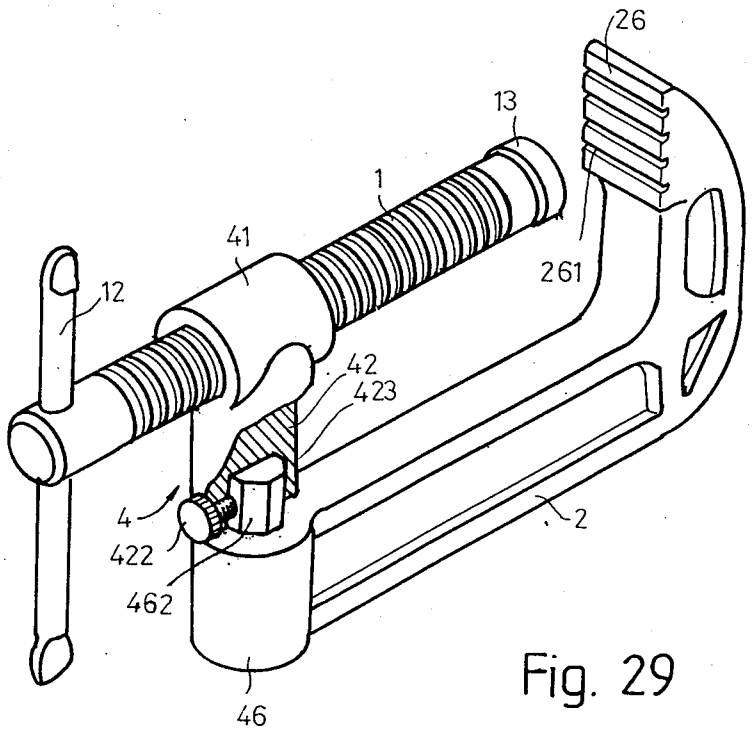
FIG. 29 is a perspectively graphic view of another embodiment of the structure as shown in FIG. 25.
Figure 32:
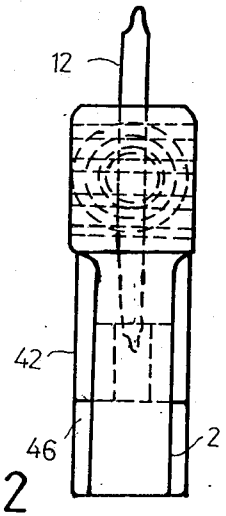
FIG. 32 is a side elevational view of the structure as shown in FIG. 29.
Figure 31:
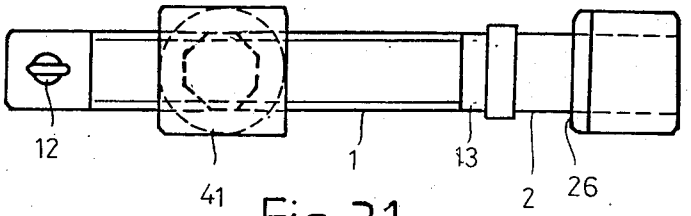
FIG. 31 is a top elevational view of the structure as shown in FIG. 29.
Figure 30:
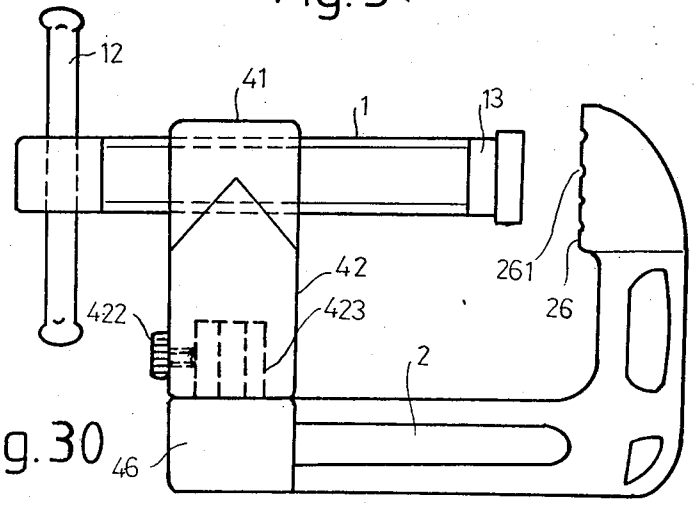
FIG. 30 is a front elevational view of the structure as shown in FIG. 29.
Figure 33:
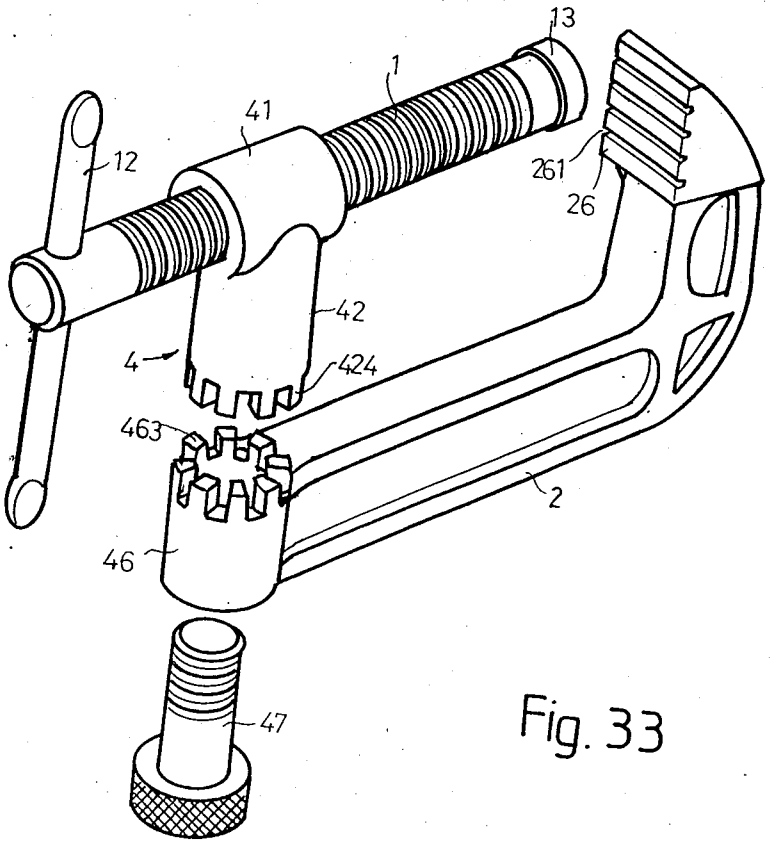
FIG. 33 is a perspectively graphic view of the structure of the present invention in which support shaft is double sectional type and it can make angular adjusting and setting work by toothed slot.
Figure 36:
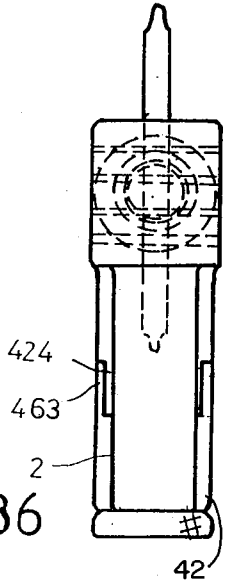
FIG. 36 is a side elevational view of the structure as shown in FIG. 33.
Figure 35:
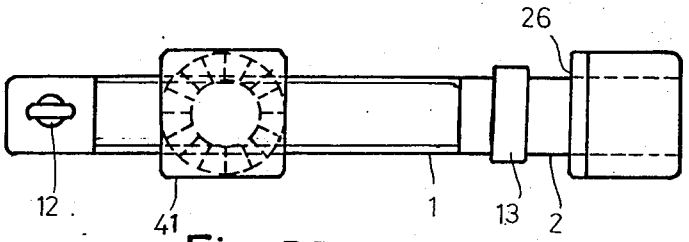
FIG. 35 is a top elevational view of the structure as shown in FIG. 33.
Figure 34:
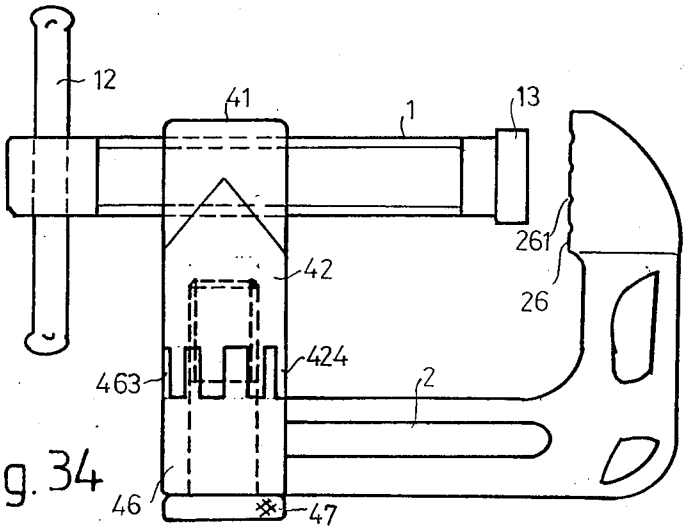
FIG. 34 is a front elevational view of the structure as shown in FIG. 33.
Figure 37:
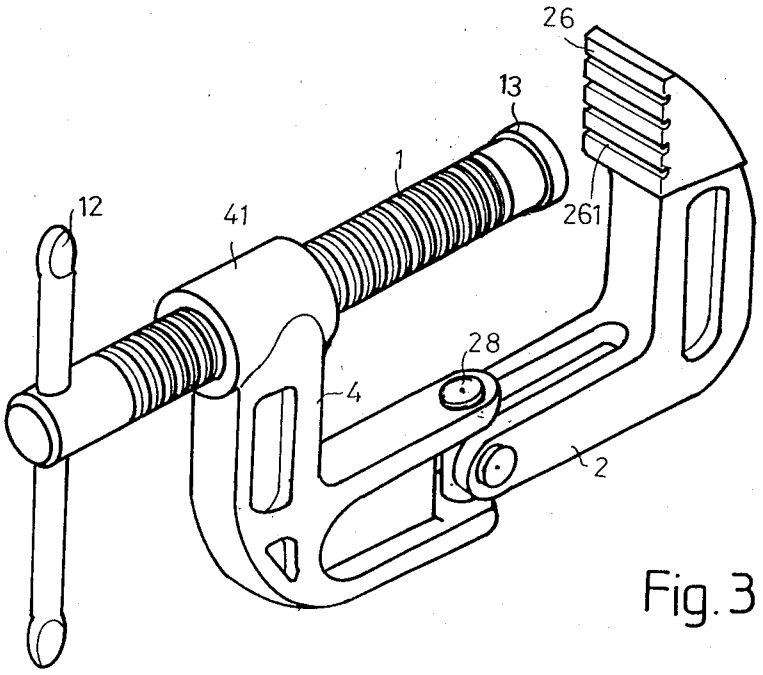
FIG. 37 is a perspectively graphic view of the structure of the present invention having universal connection apparatus in the middle section of support arm.
Figure 40:
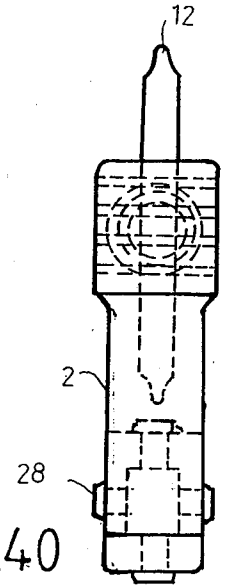
FIG. 40 is a side elevational view of the structure as shown in FIG. 37.
Figure 39:
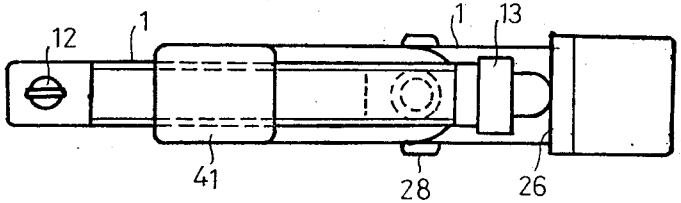
FIG. 39 is a top elevational view of the structure as shown in FIG. 37.
Figure 38:
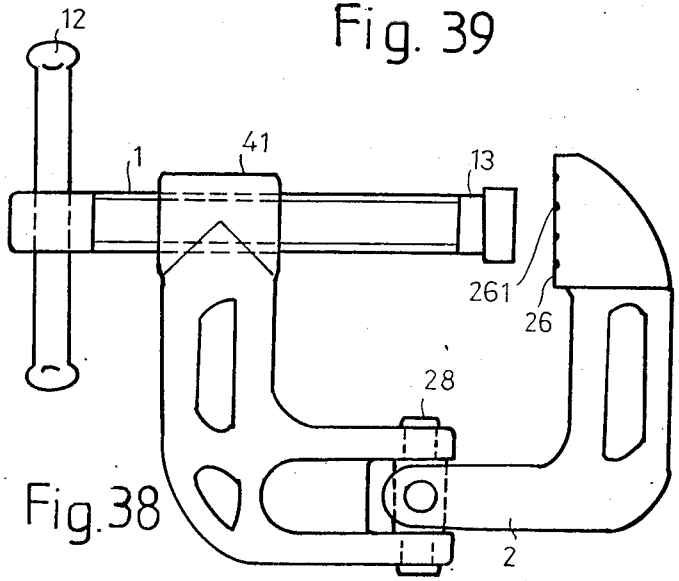
FIG. 38 is a front elevational view of the structure as shown in FIG. 37.

The present invention relates to improvement in C-shaped clamp structure and it is researched and designed to meet the above-mentioned requirement of use and the provided practical structure of each item can obtain the expected clamping function and promote C-shaped clamp in the multiple situation.

A preferred embodiment of structure of the present invention will now be described as follows in detail with reference to the examples thereof as illustrated in the accompanying drawings:

As shown in FIGS. 1–4, C-shaped clamp of the present invention mainly comprises elements of a screw (1), two support ars (2), (3) and screw support shaft (4), said screw (1) is assembled to penetrate through upper screw pipe (41) of above screw support shaft (4), at its one end, there is handle rod (12) for applying force, at another end, there is movable top block (13), said movable top block (13) can automatically adjust to match the clamping work in accordance with the design of contact surface of the working piece. The lower end of screw support shaft (4) is ladder type, its middle section (44) is a polygonal shape, its tail end (45) possesses thread. Above two support arms (2) (3), wherein one end of support arm (2) possesses a joint portion (21), in the central part of the joint portion (21), there is a polygonal joint hole (22); another end extends upward a proper height, and there is a central shaft (23), at tail end of central shaft (23), there is a ring of ringed groove (231), said central shaft is used for a clamping block (5) to penetrate, couple and set; as shown in figures, in the central part of the clamping block (5), there is a central hole (51), the diameter of said central hole (51) is slightly larger than diameter of above central shaft (23) to let clamping block (5) have movable rotary action after being placed and set; additionally, on the circumference of clamping block (5), there is vertical or parallel grooved line (52) for clamping the working piece conveniently. After the clamping block (5) is placed in the central shaft (23), then it is fixed and clamped by a C-shaped fixed sheet (24) in above ringed groove (231) and can not fall off.

One end of another support arm (3) as above-mentioned is open type and possesses two joint portions (31), in the center of two joint portions (31), there is a concentric polygonal joint hole (32); another end of support arm (3) also extends upward a suitable height and assembles a central shaft (33), and at tail end of central shaft (33) also assembles a ring of ringed groove (331), as above-mentioned, it is used for a clamping block (5) to penetrate and assemble between there, and then it is fixed and set by a C-shaped fixed sheet (24). Support arm (3) and support arm (2) make joint work at joint portions (31) (21), it is as shown in figure, the joint portion (21) of support arm (2) is clamped and placed between two joint portions (31) of support arm (3), and then screw support shaft (4) is placed in the above polygonal holes (22) (32), and washer (46) and screw nut (47) are placed in the end section (45) of screw support shaft (4) in order to make the fixing and setting work.

Character of the present embodiment is that on the joint portions (21) (31) of two support arms (2) (3), there are polygonal joint holes (22) (32) to match polygonal middle section (44) of screw support shaft (4), and according to the requirement of clamping and design of working piece, user can release screw nut (47), and adjust the direction and angle between two support arms (2) (3), and then screw the screw nut (47), and screw (1) and movable clamping block (5) on two support arms (2) (3) can be used to adjust the best clamping angle for clamping the working piece, it means, the present embodiment can the clamp irregular working piece by adjusting the clamping angle between two support arms (2) (3) and movable clamping block (5).

As shown in FIGS. 5–8, it is another embodiment of the present invention, and the important difference between these two embodiments are that screw support shaft (4) is a design of circular diameter and possesses thread at lower end; on the joint portion (21) (31) of two support arms (2) (3), there is a circular central hole (25) for matching screw support shaft (4); another end of two support arms (2) (3) also respectively extends upward a suitable height and respectively forms fixed clamping surfaces (26) (35), and on each of clamping surfaces (26) (35), there are grooved lines (261) (351). Also in this design, screw nut (47) can be released to adjust angle between two support arms (2) (3) in order to obtain expected function of clamping the working piece tightly.

As shown in FIGS. 9–12, it is another structural design of above two embodiments, it relates to a clamping mechanism with double screw or threaded rod (1), and its main character is that one end of a common base (6) extends upward a proper height and forms a substantially-parallel double screw pipe or transverse support (61) which is respectively used for a screw (1) to be received in a threaded hole therein and penetrate and couple between there; a handle is carried by the extending forward end portion of each rod Another end of common base (6) also extends upward a proper height and assembles two central transverse supports having shafts (62), there respectively assembles a ring of ringed groove (621) for two clamping blocks (5) to couple in it respectively and have function of moving, rotating and adjusting about respective vertical axes. This kind of structural design can use two screws (1) to match two movable clamping blocks (5) in order to clamp larger irregularly shaped working piece, its further character is to assemble joint slot (63) at bottom side of common base (6), through said joint slot (63), the present invention and the working table of processing machine can make expected fixing and joining work and obtain more multiple processing work.

Besides above embodiments, the present embodiment also supply the following several low cost mutually acceptable partial improved structures, one of them is as shown in FIGS. 13–16, it is suitable for c-shaped clamp in which the working piece possesses small incline, its character is that at the position of middle section of support arm (2), there are joint portions (27) (27') which are movably jointed by a joint pin (271) to become a double sectional structure, one end of the fixed clamping surface (26) of support arm (2) can make deflective adjustment of small angle, it is suitable for clamping the working piece with small incline. As shown in FIGS.

17–20, it is another embodiment of structure of another c-shaped clamp which can make deflective adjustment, it is mainly characterized in that support shaft (4) of screw (1) is double sectional design, its upper section (42) assembles a shaft hole (421) in the central part, on the circumference, there is a fixed screw (422) to communicate with shaft hole (421); its lower section (46) is ladder type and possesses a central shaft (461), in combination central shaft (461) is placed in above shaft hole (421), the direction and angle of screw (1) are adjusted by releasing and locking the fixed screw (422) in order to clamp the required working piece. Structure as shown in FIGS. 21–24 is the contrary design of this kind of embodiment, that is, central shaft (461) is assembled on the upper section (42) of screw support shaft (4), shaft hole (421) is assembled in the central part of end section (46), fixed screw (422) is also changed to assemble on the circumference of end section (46), the obtained function is as same as above mentioned.

As shown in FIGS. 25–28, it is another embodiment of C-shaped clamp of the present invention, it is mainly characterized in that the upper section (42) of screw support shaft (4) is ladder type and possesses a polygonal central shaft (423), and in the central part of end section, there is a polygonal shaft hole (462) for matching each other, its can change the accepting angle of upper section (42) of polygonal support shaft and the above polygonal shaft hole (462), in order to obtain the above function of adjusting the clamping angle. FIGS. 29–32 are the contrary design of above embodiment, that is,. at the upper section (42) of screw, there is a polygonal shaft hole (462), lower section (46) is ladder type and possesses a polygonal central shaft (423), also it can adjust the clamping angle of the present invention, in order to obtain the expected function of clamping the working piece. Both of these two embodiments use the combinative character of polygonal central shaft and polygonal shaft hole and can change the accepting angle without the locking apparatus and make the fixing and coupling work.

As shown in FIGS. 33–36, it is another embodiment of C-shaped clamp of the present invention which can adjust the clamping angle, its character is that screw support shaft (4) is double sectional design, at the corresponding end surface of upper section (42) and end section (46), there are the corresponding toothed slots (424) (463), and a fixed screw bolt (47) which can fix and lock upward, and the fixed screw bolt (47) is released to let the upper section (42) and lower section (46) of screw support shaft (4) separate from the engaged status, and further change the engaging angle of both of them, and then lock and fix the fixed screw bolt (47) in order to adjust the clamping angle of the c-shaped clamp of the present invention.

As shown in FIGS. 37–40, it is the other embodiment of c-shaped clamp of the present invention, its character is that support arm (2) divides into two sections in the middle sectional portion, and is linked by a universal joint (28), through the device of said universal joint (28), one end of fixed clamping surface (26) of support arm (2) can make various changes of different positions to match screw (1) and clamp various cubic irregular or little changed clamping surface working pieces, its application is more practical than above-mentioned embodiments.

Figure 41:
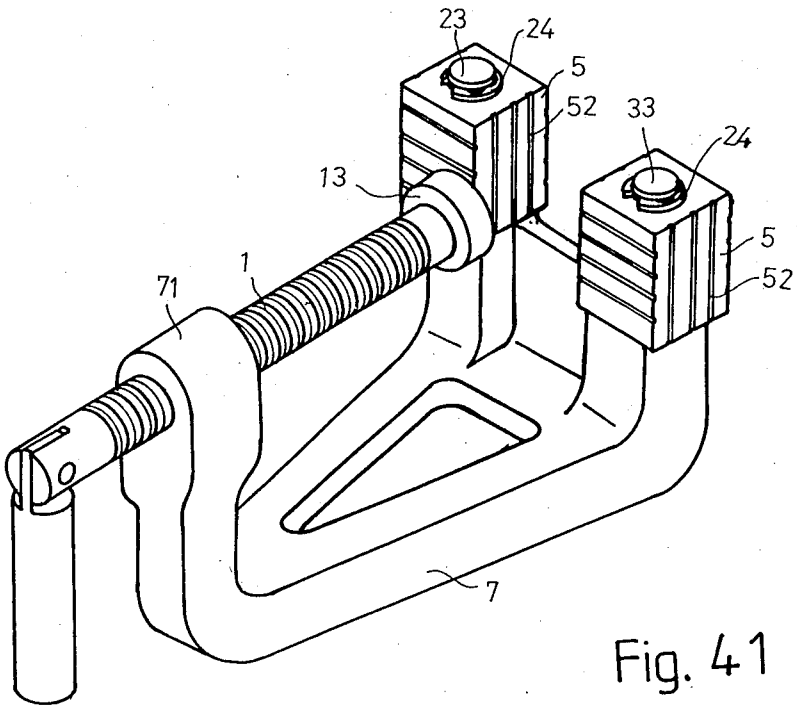
FIG. 41 is the three-dimensional view of the fixed type single screw and double support arm structure.

Besides, the embodiment of the utilization shown in FIG. 1 can be further in a form of structure with a fixed angle of intersection, and FIG. 41 is the view of the embodiment of its utilization, which is formed by a C-shaped seat in an approximate triangle and no repetition is made here, since the remaining structure is the same as shown FIG. 1.

Figure 42:
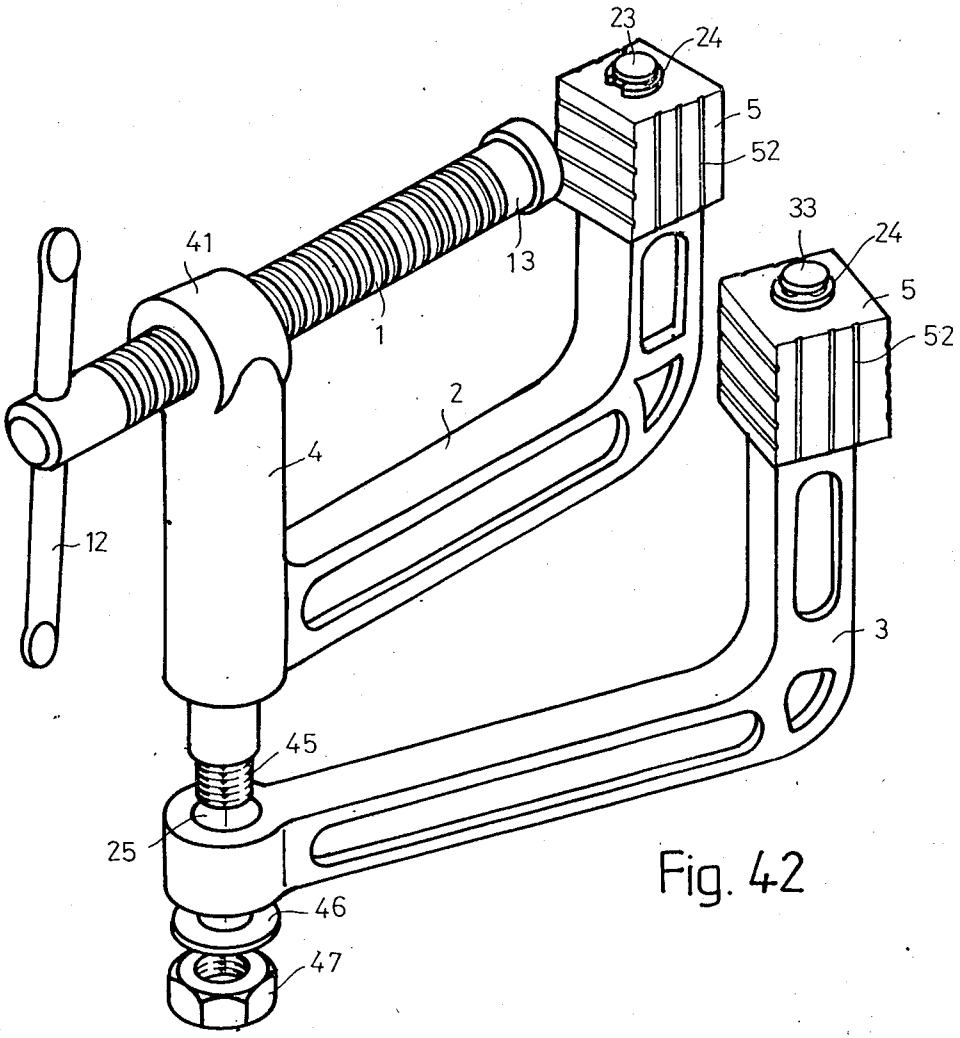
FIG. 42 is the three-dimensional view of an embodiment of the utilization of the overlapped type auxiliary support arm structure.

FIG. 42 is the embodiment of the embodiment of the utilization shown in FIG. 1 in which one of the support arms and the support shaft (4) is joined together to form an integral C-shaped structure, and said support shaft extends downward to be inserted into the motion support arm (3), thus serving as a structure for directional adjustments.

Summing up, improved structure of C-shaped clamp of the present invention not only break through the single functional structure of conventional C-shaped clamp, and but also in the concept of design, it is creative and novel, therefore, its practical function is good and acknowledged. And, in manufacturing the above each embodiment can be individually used or mixed, and further develops its multiple practicability and economy.

What is claimed is:

1. A unitary integrally casted dual C-clamp structure, comprising, in combination, a common base having forward and rearward ends, said base having a slot formed therein, facilitating mounting the base on a support, a first pair of substantially-parallel supports formed integrally with the forward end of the base transversely thereof, each of the supports being non-movable relative to one another and having a threaded hole formed therein along an axis substantially transverse thereto, a threaded rod in each hole, the rods having respective longitudinal axes and extending substantially parallel to each other and to the slot of the base, the rods having respective forward and rearward end portions, the forward end portion of each rod extending forwardly beyond the respective upstanding support, a crank handle pivotably carried by the extending forward end portion of each rod, said handle being pivotable a full 180 degrees, a clamping element carried by the rearward end of each rod, a second pair of substantially-parallel spaced-apart upwardly extending supports formed integrally with the rearward end of the base transversely thereof, each of said supports terminating below the longitudinal axes of the threaded rods, each second support having a respective end portion defining a respective shoulder thereon, each respective end portion provided with a shaft thereon, each of the shafts having a respective longitudinal axis extending substantially parallel to the other respective longitudinal axis and perpendicular to the longitudinal axes of the threaded rods, a freely rotatable prismatically-shaped clamping block carried on each respective shaft end abutting and being supported by the shoulder of each respective second support, each clamping block being substantially uniformly polygonal in cross-section and having a plurality of faces, and each of the faces of the clamping blocks being provided with grooves formed thereon, the grooves of each face being substantially parallel to one another and further being substantially perpendicular to the grooves of the faces immediately adjacent thereto, each clamping block being spaced from the other and each being freely rotatable on its respective second support independently of one another and may be automatically angularly adjusted by a workpiece being clamped relative to its respective second support about an axis substantially perpendicular to the longitudinal axis of its respective threaded rod, thereby facilitating the clamping of an irregularly-shaped workpiece in the C-clamp structure, wherein each clamping block is rotatably retained on one of said shafts by a retaining means which permits free rotation of the clamp block by the workpiece.

* * * * *